United States Patent [19]

Everett

[11] Patent Number: 4,951,810

[45] **Date of Patent: *Aug. 28, 1990**

[54] FLUID CONTROL DEVICE FOR ELECTRICAL SWITCH UNIT

[75] Inventor: Charles J. Everett, Killingworth, Conn.

[73] Assignee: Robertshaw Controls Company, Richmond, Va.

[ * ] Notice: The portion of the term of this patent subsequent to Apr. 3, 2007, has been disclaimed.

[21] Appl. No.: 485,385

[22] Filed: Feb. 26, 1990

Related U.S. Application Data

[62] Division of Ser. No. 419,825, Oct. 11, 1989, which is a division of Ser. No. 217,398, Jul. 11, 1988, Pat. No. 4,914,264.

[51] Int. Cl.[5] ..... H01H 35/34

[52] U.S. Cl. ..... 200/83 A; 200/294; 200/332; 73/723

[58] Field of Search ..... 200/332, 332.1, 83 R, 200/83 S, 83 A, 83 J, 83 L, 83 SA, 82 C, 293, 294; 91/1; 92/5 R; 73/717, 723; 307/118; 340/626

[56] References Cited

U.S. PATENT DOCUMENTS

| | | | |
|---|---|---|---|
| 2,800,549 | 7/1957 | Guthrie | 200/83 S |
| 3,005,887 | 10/1961 | Robson | 200/83 A |
| 3,752,942 | 8/1973 | McAfee | 200/83 A |
| 3,852,547 | 12/1974 | Dietz | 200/83 A |
| 3,938,076 | 2/1976 | Hayashi | 200/83 A |
| 3,989,910 | 11/1976 | Russell | 200/83 A |
| 4,101,747 | 7/1978 | Houk | 200/83 A |
| 4,182,941 | 1/1980 | Tashiro | 200/83 S |
| 4,217,471 | 8/1980 | Ulbing | 200/83 S |
| 4,289,963 | 9/1981 | Everett | 250/231.19 |
| 4,453,062 | 6/1984 | Brown | 200/332 |
| 4,604,793 | 8/1986 | Everett | 29/622 |

FOREIGN PATENT DOCUMENTS

| | | | |
|---|---|---|---|
| 264490 | 6/1970 | U.S.S.R. | 200/332 |
| 2098399 | 11/1982 | United Kingdom | 200/332 |

*Primary Examiner*—Gerald P. Tolin

*Attorney, Agent, or Firm*—Candor, Candor & Tassone

[57] ABSTRACT

A control device, switch unit therefor and methods of making the same are provided, the electrical switch unit comprising a switch having a movable actuator, a lever pivotally carried by the switch unit and having one end adapted to be operatively interconnected to a movable part of a control device so as to be pivoted by the movement thereof, the lever being operatively interconnected to the actuator to operate the switch between the different conditions thereof in relation to the pivoted position of the lever, and a pair of mounting plates respectively having holding structure that hold the switch between the plates and respectively having pivot structure that pivotally mount the lever between the plates whereby the plates, the switch and the lever form a self-supporting switch unit.

9 Claims, 4 Drawing Sheets

FLUID CONTROL DEVICE FOR ELECTRICAL SWITCH UNIT

CROSS REFERENCE TO RELATED APPLICATION

This application is a divisional patent application of its copending parent patent application Ser. No. 419,825, filed Oct. 11, 1989, which, in turn, is a divisional patent application of its copending parent patent application Ser. No. 217,398 filed July 11, 1988 now U.S. Pat. No. 4,914,264.

BACKGROUND OF THE INVENTION

1. Field of the Invention

This invention relates to a new control device having an electrical switch unit and a new method of making the new control device as well as to a new electrical switch unit and a new method of making the new electrical switch unit.

2. Prior Art Statement

It is known to provide a control device comprising a housing means that is divided into two chambers by a movable wall means that is responsive to a pressure differential created between the chambers, an electrical switch means carried by the housing means and having a movable actuator, and a lever pivotally carried by the housing means and having one end operatively interconnected to the wall means so as to be pivoted by the movement thereof, the lever being operatively interconnected to the actuator to operate the switch means between the different conditions thereof in relation to the pivoted position of the lever. For example, see the U.S. Pat. No. 3,989,910 to Russell et al.

Also see the U.S. Pat. No. 4,289,963 to Everett, and the U.S. Pat. No. 4,604,793 to Everett, for similar control devices.

SUMMARY OF THE INVENTION

One of the features of this invention is to provide a new self-supporting electrical switch unit for a control device, the switch unit reducing assembly costs and eliminating hardware commonly utilized which has the potential to loosen over time.

In particular, it was found according to the teachings of this invention that the switch unit can comprise a switch means, a lever, and a pair of mounting plate means respectively having holding means holding the electrical switch means between the plate means and respectively having pivot means that pivotally mount the lever for the switch means between the plate means whereby the plate means, the switch means and the lever form a self-supporting unit that is adapted to be carried by the housing means of a control device or the like.

For example, one embodiment of this invention provides a control device comprising a housing means divided into two chambers by a movable wall means that is responsive to a pressure differential created between the chambers, an electrical switch means carried by the housing means and having a movable actuator, a lever pivotally carried by the housing means and having one end operatively interconnected to the wall means so as to be pivoted by the movement thereof, the lever being operatively interconnected to the actuator to operate the switch means between the different conditions thereof in relation to the pivoted position of the lever, and a pair of mounting plate means respectively having holding means that hold the switch means between the plate means and respectively having pivot means that pivotally mount the lever between the plate means whereby the plate means, the switch means and the lever form a self-supporting unit that is carried by the housing means.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new electrical switch unit for a control device or the like, the electrical switch unit of this invention having one or more of the novel features of this invention as set forth above or hereinafter shown or described.

Another object of this invention is to provide a new method of making such an electrical switch unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
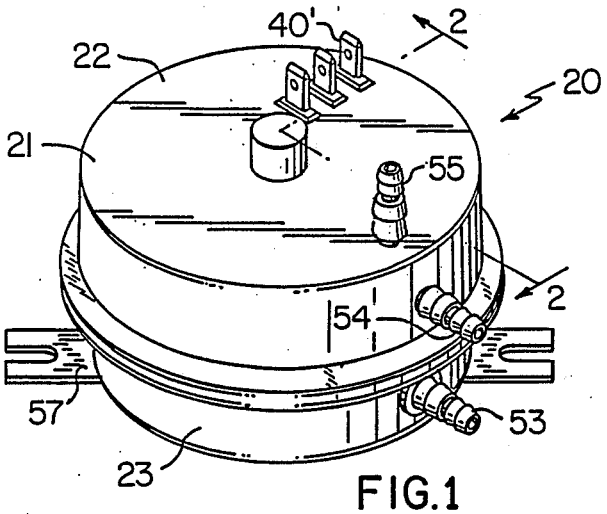
FIG. 1 is a top perspective view of the new control device of this invention.

While the various features of this invention are hereinafter described and illustrated as being particularly adapted to provide a differential pressure operated control device, it is to be understood that the various features of this invention can be utilized singly or in various combinations thereof to provide other types of control devices as desired.

Therefore, this invention is not to be limited to only the embodiments illustrated in the drawings, because the drawings are merely utilized to illustrate some of the wide variety of uses of this invention.

Referring now to FIGS. 1–6, a new control device of this invention is generally indicated by the reference numeral 20 and comprises a housing means 21 having a cup-shaped cover 22 formed of any suitable material, such as a thermoplastic material that has been molded in the shape as illustrated, and a generally cup-shaped base 23 formed of any suitable material, such as a metallic material that has been drawn into the shape illustrated, the open end of the base 23 having a turned over peripheral edge means 24 clamping against an outwardly extending annular flange means 25 at the open end of the cover member 22 to not only hold the cover member 22 and base 23 together, but also to sandwich an outer peripheral portion 26 of a flexible diaphragm 27 therebetween together with a sealing gasket means 28 so that the housing means 21 is divided into two internal chambers 29 and 30 by the movable wall means 27.

Figure 5:
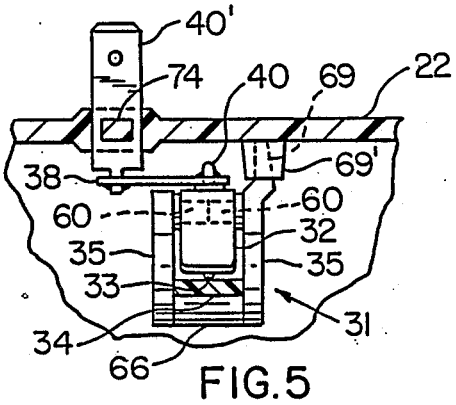
FIG. 5 is a fragmentary cross-sectional view taken on line 5—5 of FIG. 2.
Figure 7:
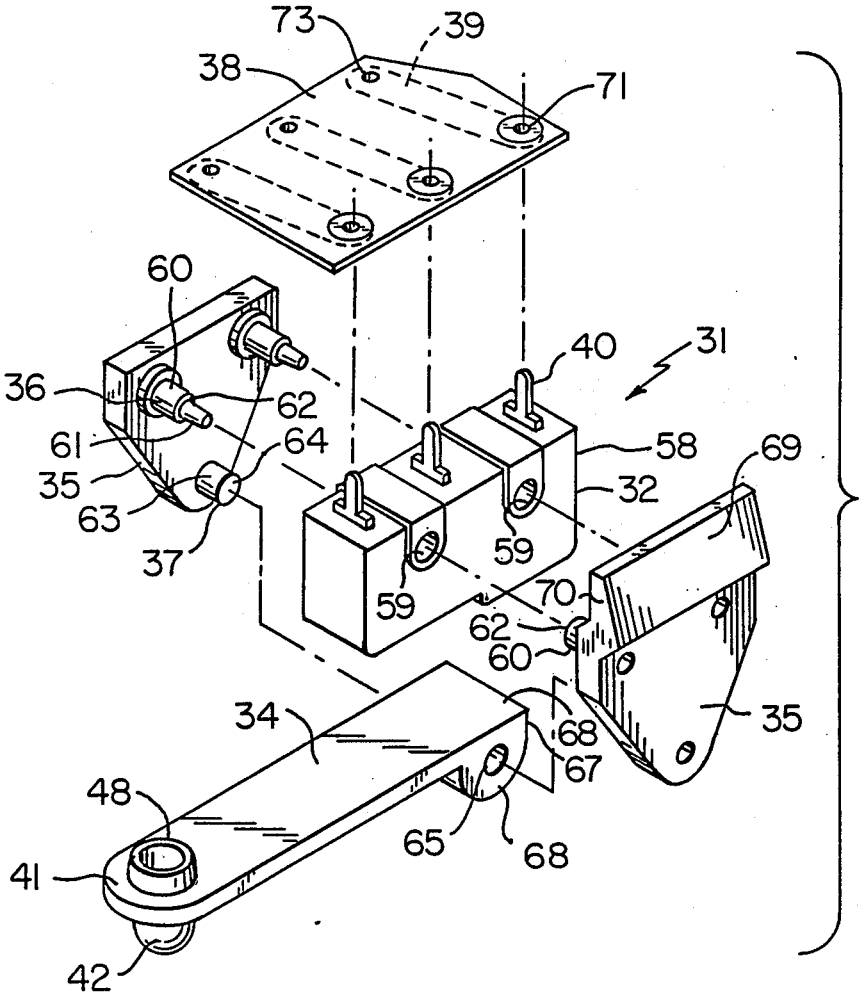
FIG. 7 is an exploded perspective view of the parts of the electrical switch unit of this invention that is utilized in the control device of FIGS. 1–6.

A new self-supporting electrical switch unit or subassembly of this invention is generally indicated by the reference numeral 31 and is carried by the housing means 21 of the control device 20 in the chamber 30 thereof in a manner hereinafter set forth, the electrical switch unit 31 as illustrated in FIG. 7 comprises an electrical switch means 32 having a movable actuator or plunger 33, FIGS. 2 and 3, a lever 34 that is pivotally mounted to the switch unit 31 in a manner to operate the movable actuator 33 in relation to the pivoted position of the lever 34, a pair of plate means 35 respectively having holding means 36 for holding the switch means 32 between the plate means 35 and respectively having pivot means 37 for pivotally mounting the lever 34 between the plate means 35, and a circuit board means 38 having electrical circuit means 39 printed thereon for interconnecting outwardly extending terminal means 40 of the switch means 32 with terminal means 40' of the control device 22 that have been molded in place during the forming of the cover 22 thereof as illustrated in FIG. 5 and in a manner hereinafter set forth.

Figure 2:
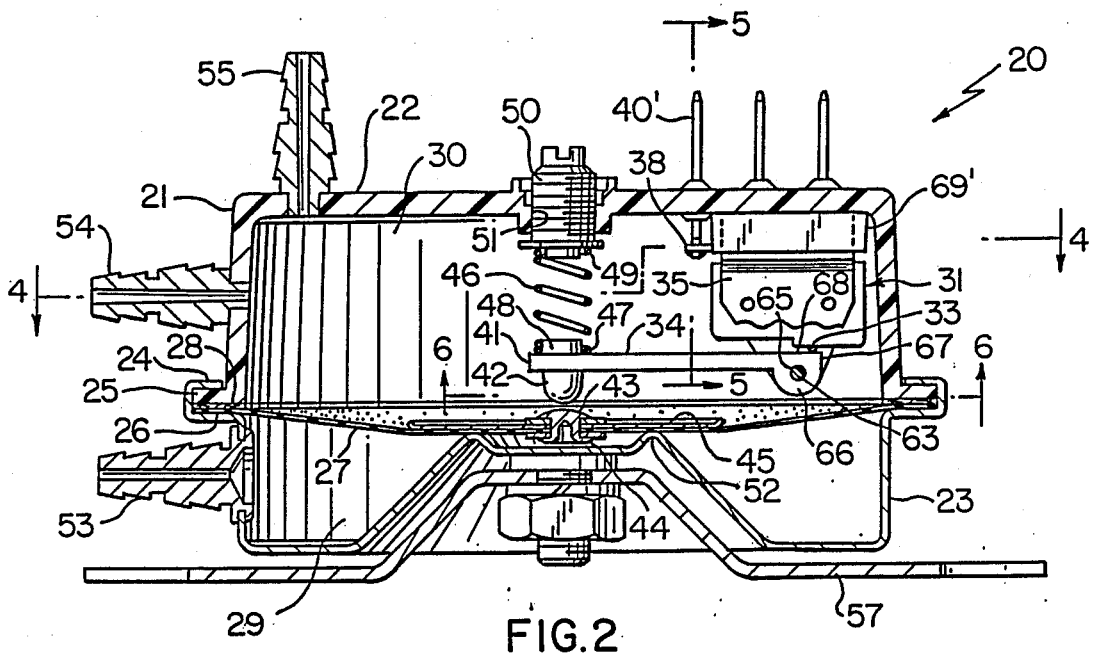
FIG. 2 is an enlarged cross-sectional view of the control device of FIG. 1 and is taken on the line 2—2 of FIG. 1.
Figure 3:
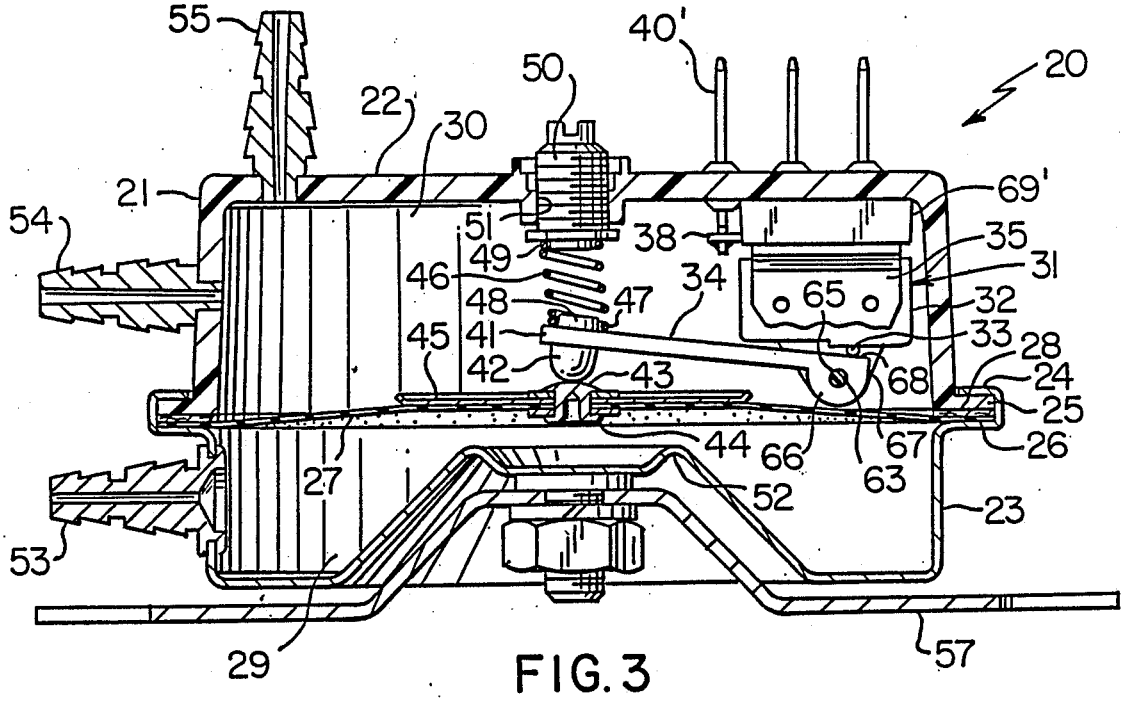
FIG. 3 is a view similar to FIG. 2 and illustrates the control device in another operating condition thereof.
Figure 4:
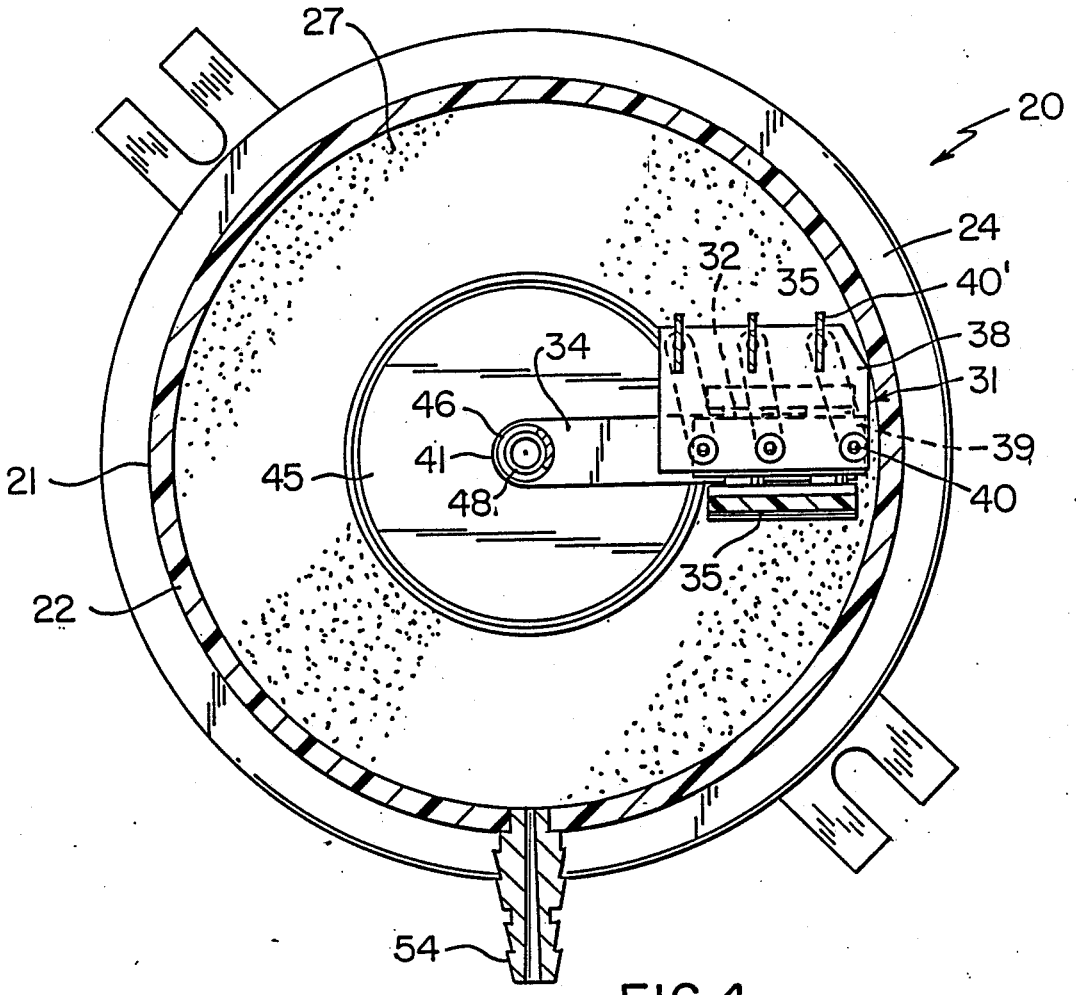
FIG. 4 is a cross-sectional view taken on line 4—4 of FIG. 2.

The lever 34 has its free end 41 provided with an outwardly extending arcuate and transverse abutment means 42 which is adapted to abut against an arcuate surface 43 on a fastening member 44 that passes centrally through the diaphragm 27 and secures a diaphragm backup plate means 45 thereto as illustrated in FIG. 2.

In this manner, a coiled compression range or calibration spring 46 is adapted to have one end 47 thereof disposed over an outwardly extending annular spring retaining flange means 48 formed on the other side of the free end 41 of the lever 34 so as to bear against the free end 41 of the lever 34. The other end 49 of the range spring 46 bears against a threaded adjusting member or calibration screw 50 carried in an opening 51 in the cover 22 that can be threaded by the initial insertion of the screw 50 in the opening 51 so that the force of the range spring 46 can be adjusted by the adjusting member 50, the force of the range spring 46 tending to pivot the end 41 of the lever 34 downwardly in FIG. 2 and thereby tend to place the diaphragm 27 in its down position against an annular abutment means 52 formed by the base 23 to stop such downward movement of the diaphragm 27. This down position of the diaphragm 27 and the lever 34 causes the actuator 33 to place the switch means 32 in one operating condition thereof and when the pressure differential created across the diaphragm 27, by having a vacuum drawn in the chamber 30 and/or by a pressure buildup in the chamber 29, the diaphragm 27 moves upwardly in opposition to the force of the range spring 46 in the manner illustrated in FIG. 3 to cause the lever 34 to pivot in a clockwise direction and thereby cause the actuator 33 of the switch means 32 to operate the same to another condition thereof, such actuation of the electrical switch means being well known in the art for controlling any desired structure. For example, see the aforementioned U.S. Pat. No. 3,989,910 to Russell et al; the U.S. Pat. No. 4,289,963 to Everett, and the U.S. Pat. No. 4,604,793 to Everett, whereby these three patents are being incorporated into this disclosure by this reference thereto.

Therefore, since the use of the control device 20 of this invention is well known in the art, only the details thereof necessary to understand the features of this invention will be hereinafter set forth.

Fluid pressure can be directed to the chamber 29 of the control device 20 through a suitable inlet nipple means 53 while the pressure in the chamber 30 can be evacuated or vented through suitable nipple means 54 and/or 55. Alternately, the base 23 of the housing means 21 of the control device 20 can be changed to accommodate other bases thereof, such as the base 23A of FIG. 8 that has a nipple means 53A extending out of the bottom thereof or the base 23B of FIG. 9 wherein the inlet 53B through the base 23B is provided through the threaded stud 56 that is carried by the base 23 for fastening the control device to a suitable bracket means 57 as illustrated in FIG. 2.

The electrical switch means 32 has a substantially rectangularly shaped housing means 58 and has a pair of mounting opening means 59 passing completely therethrough whereby the holding means 36 of the plate means 35 comprise outwardly directed substantially cylindrical post means 60 for being received in the openings 59, the post means 60 of one of the plate means 35 having reduced cylindrical end portions 61 which are adapted to be received in cooperating openings (not shown) in the post means 60 of the other plate means 35 so that the ends 62 of the cooperating post means 60 are adapted to abut against each other in the manner illustrated in FIG. 5 within the openings 59 of the switch means 32. The abutting post means 60 of the plate means 35 are secured together in any suitable manner, such as by utilizing a suitable adhesive means or if the plate means 35 are formed of suitable plastic material, the same can be secured together by utilizing a suitable solvent in a manner well known in the art. In this manner, the plate means 35 and the switch means 32 are secured together with the switch means 32 being between the plate means 35.

Figure 6:
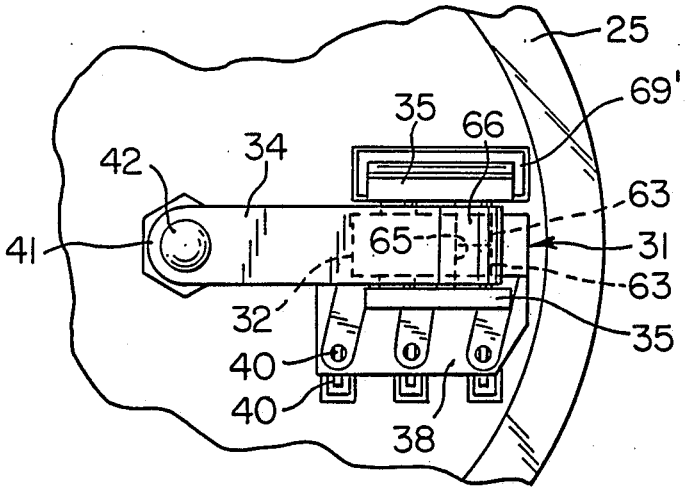
FIG. 6 is a fragmentary cross-sectional view taken on line 6—6 of FIG. 2.

The pivot means 37 of the plate means 35 also comprise substantially cylindrical post means 63 having flat ends 64 and are adapted to be respectively received in an opening means 65 formed through an enlargement 66 on the end 67 of the lever 34 so as to substantially abut together in the manner illustrated in FIG. 6 and thereby pivotally mount the lever 34 to and between the plate means 35 whereby a flat surface 68 on the free end 67 of the lever 34 is adapted to engage against the actuating plunger 33 of the electrical switch means 32 in such a manner that a relatively high ratio moment arm arrangement is provided by the pivoted lever 34 for acting on the actuator plunger 33.

One of the plate means 35 has a tapered extension 69 on one end 70 thereof for being received in an open ended substantially rectangular extension 69' of the cover 22 to be secured therein by any suitable means, such as by a suitable adhesive or by utilizing a solvent when the plate means 35 are formed of a suitable plastic material that is compatible with the plastic material of the cover 22 for being secured thereto by a suitable solvent or the like.

In this manner, it can be seen that the switch unit 31 can be formed in the manner previously set forth by securing the switch means 32 between the plate means 35 which not only hold the switch unit 32 therebetween, but also which pivotally mount the lever 34 therebetween with the switch unit 31 thereafter being adapted to have the circuit board means 35 fastened thereon by inserting the extending terminal portions 40 of the switch means 32 through suitable openings 71 passing through the board means 38 at the circuit means 39 thereof and in turn inserting extending portions 72 of the housing terminals 40' through other openings 73 formed through the circuit board means 38 at the circuit means 39 thereof in the manner illustrated in FIG. 5 while the extension 69 of the plate means 35 is received within the rectangular extension 69' of the cover member 22 to be secured therein in the manner previously set forth.

Thus, it can be seen that it is a relatively simple method of this invention to form the switch unit 31 as a self-supporting switch unit 31 that can be readily secured in the housing means 22 of the control device 20 when desired and utilizing the circuit board 39 to electrically interconnect the housing terminals 40' with the switch terminals 40 as previously set forth. Of course, the projecting portions of the terminals 40 and 40' through the circuit board openings 71 and 73 can then be soldered to the printed circuit means 39 if the press-fit relation does not provide sufficient electrical contact therebetween. In this manner, the lever 34 provides the operating interconnection between the electrical switch means 32 and the movable wall 27 of the control device 20 to operate any desired apparatus through the changing condition of the switch means 32 in relation to the pivoted position of the lever 34 in the manner previously set forth.

Thus, it can be seen that the control device 20 of this invention is designed to reduce the cost, size and complexity of manufacture thereof to provide a relatively low pressure differential control, the control device 20 consisting essentially of a pressure chamber 29 and a vacuum chamber 30 separated by a moving spring loaded diaphragm 27.

Figure 8:
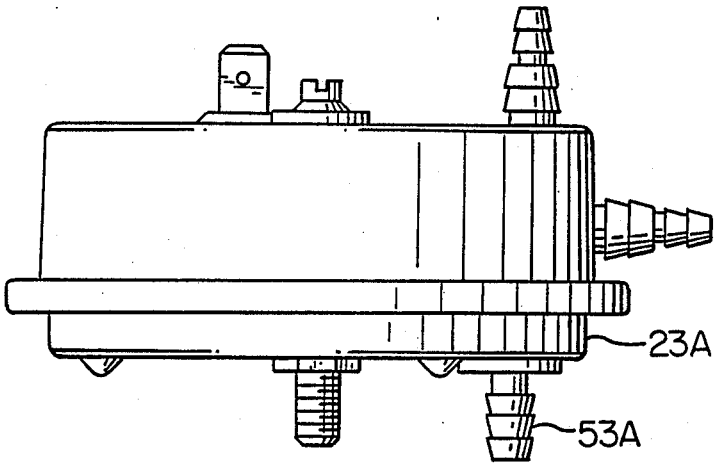
FIG. 8 is a side view of another control device of this invention.
Figure 9:
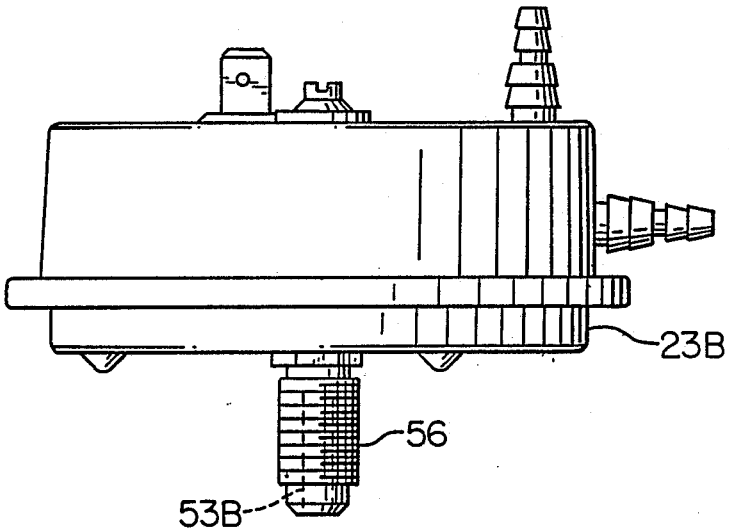
FIG. 9 is a view similar to FIG. 8 and illustrates another control device of this invention.

The base 23 of the control device 20 is simply a drawn metal can and a number of shapes can be used to accommodate a variety of pressure port types and locations, as represented by FIGS. 2, 8 and 9, making possible a wide range of applications.

The cover 22 of the control 20 of this invention can be molded of engineering grade thermoplastic materials which permits a selection of field wiring terminals 40' to be integrally "molded in" during the manufacturing process of the cover 22, such as by having the material of the cover 22 pass through suitable openings 74, FIG. 5, formed through the terminals 40' to secure the same in place, thereby reducing assembly costs and preventing any movement of the terminals 40' during field installation.

In addition, the construction of the control device 20 of this invention permits the self-supporting electrical switch unit or sub-assembly 31 of this invention to be solvent bonded in place and thereby again reducing assembly costs and eliminating mounting hardware commonly used which has the potential of loosening over time.

Another feature of the control device 20 of this invention is that the same allows a use of a thread forming calibration screw 50 that forms its own threads in the opening 51 when initially inserted therein thereby eliminating a tapping operation and still providing excellent torque to prevent drift of the operating setting of the control 20 of this invention. The self-tapping screw 50 also provides a leak-proof seal without the use of additional material or devices.

It can be seen that a variety of vacuum ports 54, 55 etc. can be applied to the cover 22 in required positions by simply solvent bonding them in place after providing a suitable opening in the cover 22 therefor.

In regards to the switch unit 31 of this invention, it can be seen that the electrical switch means 32 is adapted to be coupled to the terminals 40' of the control device 20 through the small double sided printed circuit board means 38 so that this unique manner of assembly allows the use of the same switch 32 for all applications without regard to the variety of field connection terminals 40' that may be molded into the cover 22.

It can also be seen that because the operating or range spring 46 is mounted between the calibration screw 50 and the operating lever 34, which bears on the diaphragm assembly 43, a variety of range springs 46 can be used to provide differing operational ranges for the control device 20 of this invention.

Also, it can be seen that the base 23 of the housing means 21 of this invention is adapted to readily clamp the diaphragm 27 and sealing gasket 28 in the assembled relation with the cover 22 in a simple and effective manner.

Therefore, it can be seen that this invention not only provides a new control device and a new method of making the same, but also this invention provides a new self-supporting electrical switch unit or sub-assembly and a new method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a housing means divided into two chambers by a movable wall means that is responsive to a pressure differential created between said chambers, an electrical switch means carried by said housing means and having a movable actuator, and a lever pivotally carried by said housing means and having opposed ends one of which is interconnected to said wall means so as to be pivoted by the movement thereof, said lever being operatively interconnected to said actuator to operate said switch means between the different conditions thereof in relation to the pivoted position of said lever, the improvement comprising a pair of mounting plate means respectively having holding means that holds said switch means between said plate means and respectively having pivot means that pivotally mount said lever between said plate means and between said opposed ends of said lever whereby said plate means, said switch means and said lever form a self-supporting unit that is carried by said housing means and has the other end of said lever acting on said actuator of said switch means, said housing means having an opening means therein, one of said plate means having an extension disposed in said opening means in said housing means and being secured therein so that said self-supporting unit is carried by said housing means.

2. A control device as set forth in claim 1 wherein said one end of said lever has an arcuate abutment thereon that engages said movable wall means.

3. A control device as set forth in claim 2 and comprising a range spring having one end bearing against said one end of said lever in a direction to tend to force said abutment against said movable wall means.

4. A control device as set forth in claim 1 wherein said switch means comprises a housing having opening means passing therethrough, said holding means of said plate means comprising post means extending therefrom and respectively being received in said opening means of said housing.

5. A control device as set forth in claim 1 wherein said lever has opening means passing therethrough, said pivot means of said plate means comprising post means extending therefrom and respectively being received in said opening means of said lever.

6. A control device as set forth in claim 1 wherein said opening means of said housing means comprises an elongated slot means, said extension of said one of said plate means being an elongated wedge-shaped structure disposed in said elongated slot means.

7. A control device as set forth in claim 1 and comprising a board means having electrical circuit means thereon, said switch means having terminal means extending therefrom and being operatively interconnected to said circuit means of said board means.

8. A control device as set forth in claim 7 wherein said board means has opening means passing therethrough, said terminal means of said switch means being received in said opening means of said board means.

9. A control device as set forth in claim 8 wherein said board means is disposed on one side of said switch means and said lever is disposed on the other side of said switch means.

* * * * *